US009216804B2

(12) United States Patent
van der Laan et al.

(10) Patent No.: US 9,216,804 B2
(45) Date of Patent: Dec. 22, 2015

(54) POD DRIVE COMPRISING A REDUCTION GEARING

(75) Inventors: Markus van der Laan, Oegstgeest (NL); Herbert Jan Koelman, Hilversum (NL); Walter Arnold van Gruijthuijsen, Oegstgeest (NL); Jan Verhaar, Oegstgeest (NL); Dirk Johannes de Blaeij, Oegstgeest (NL)

(73) Assignee: BLUE THRUSTER B.V., Bussum (NL)

( * ) Notice: Subject to any disclaimer, the term of this patent is extended or adjusted under 35 U.S.C. 154(b) by 0 days.

(21) Appl. No.: 14/114,286

(22) PCT Filed: May 1, 2012

(86) PCT No.: PCT/NL2012/050299

§ 371 (c)(1),
(2), (4) Date: Dec. 23, 2013

(87) PCT Pub. No.: WO2012/148282

PCT Pub. Date: Nov. 1, 2012

(65) Prior Publication Data

US 2014/0113511 A1 Apr. 24, 2014

(30) Foreign Application Priority Data

Apr. 28, 2011 (NL) ..... 2006678

(51) Int. Cl.

| | |
|---|---|
| ***B60L 11/00*** | (2006.01) |
| ***B63H 21/17*** | (2006.01) |
| ***B63H 5/125*** | (2006.01) |
| ***B63H 20/14*** | (2006.01) |
| ***B63H 23/02*** | (2006.01) |
| *B63H 5/07* | (2006.01) |
| *B63H 20/32* | (2006.01) |

(52) U.S. Cl.

CPC ..... *B63H 5/125* (2013.01); *B63H 20/14* (2013.01); *B63H 23/02* (2013.01); *B63H 2005/075* (2013.01); *B63H 2005/1254* (2013.01); *B63H 2005/1258* (2013.01); *B63H 2020/323* (2013.01); *B63H 2023/0283* (2013.01)

(58) Field of Classification Search

CPC ..... B63H 5/125; B63H 20/14; B63H 23/02; B63H 2005/075; B63H 2005/125; B63H 2005/1254; B63H 2005/1258; B63H 2020/32; B63H 2020/08; B63H 2020/02; B63H 2020/323; B63H 2023/02

USPC ..... 440/6, 49, 57, 61 S, 84

See application file for complete search history.

(56) References Cited

U.S. PATENT DOCUMENTS

| | | | | |
|---|---|---|---|---|
| 3,094,967 | A * | 6/1963 | Willis, Jr. | 440/58 |
| 3,487,805 | A * | 1/1970 | Satterthwaite et al. | 440/67 |

(Continued)

FOREIGN PATENT DOCUMENTS

| | | |
|---|---|---|
| DE | 10 2006 026230 | 12/2007 |
| DE | 10 2009 011289 | 9/2010 |
| EP | 1972545 | 9/2008 |
| WO | 03/023941 | 3/2003 |

(Continued)

OTHER PUBLICATIONS

International Search Report dated Aug. 28, 2012, corresponding to PCT/NL2012/050299.

*Primary Examiner* — Daniel V Venne

(74) *Attorney, Agent, or Firm* — Young & Thompson

(57) ABSTRACT

Pod drive which can be fitted to a vessel and which is provided with an electric motor which drives a propeller shaft which is likewise provided in the housing of the pod drive and is connected to a propeller which is situated outside the latter. It is proposed to use a fast-rotating electric motor in combination with a reduction gearing for driving the propeller shaft. The mounting of the propeller shaft is made particularly stable by mounting it on both sides of the electric motor. The reduction gearing may include a planetary system. The electric motor may be fitted next to the hollow propeller shaft. In this case, several electric motors can be arranged around the central propeller shaft. It is also possible to make the rotor of the electric motor hollow and to fit the propeller shaft inside the latter.

19 Claims, 7 Drawing Sheets

(56) References Cited

U.S. PATENT DOCUMENTS

| | | | | |
|---|---|---|---|---|
| 4,305,012 | A | 12/1981 | Friedel | |
| 7,559,813 | B2 * | 7/2009 | Basteck | 440/6 |
| 2008/0233814 | A1 * | 9/2008 | Reuter | 440/75 |

FOREIGN PATENT DOCUMENTS

| | | |
|---|---|---|
| WO | 2009/127774 | 10/2009 |
| WO | 2010/022954 | 3/2010 |
| WO | 2010/100092 | 9/2010 |

* cited by examiner

POD DRIVE COMPRISING A REDUCTION GEARING

The present invention relates to a pod drive comprising a housing, which housing is provided with a fastening means for fastening to a vessel, wherein said housing is elongate and is provided with opposite first and second ends and a rotary engine is fitted in said housing, wherein the rotation shaft of said electric motor extends in the direction of the first end/second end, the input shaft of a reduction gearing is connected to said electric motor, wherein the output shaft of said reduction gearing comprises a mounted propeller shaft which extends through the housing to a propeller which is situated outside the latter.

Such a pod drive, which is also referred to as an azimuth thruster or pod, uses an electric motor, while the ship is often provided with a unit which is driven by a diesel engine. The use of a pod drive has many advantages, but the environmental advantage has become increasingly important in the last few years. This is due to the fact that the diesel engine used can be operated continuously in an optimum operating range, as a result of which its emissions are limited as much as possible. In addition, it is possible to provide relatively large vessels with several diesel-driven generators, in which case only a single unit operates in the case of a low energy demand, as is the case when maneuvering in ports. In addition, when using various units, one unit may be suitable for running on cleaner fuel and be designed to emit fewer emissions.

Although, in view of the above, the use of pod drives is promising, the conflicting problem arises that a slow-rotating propeller or propeller shaft is required for optimum efficiency, but that a large and expensive electric motor is required to achieve such a low speed. As a rough guide, the size of an electric motor is proportional to the torque supplied; the torque supplied is in turn proportional to the dimensions of the electromagnetic parts of stator and rotor and thus roughly proportional to the cost price of the electric motor. In addition, the large electric motor also has a decelerating effect on the water flowing past, in particular if a pull propeller is involved. Due to this problem, a compromise is often applied, i.e. to cause the propeller to rotate (slightly) more quickly than the optimum value, as a result of which a smaller electric motor can be used. As a guide, the propeller efficiency is often 3-7% below the optimum value. This problem can be solved by providing a reduction gearing between the electric motor and the propeller shaft. An example of such a construction can be found in U.S. Pat. No. 4,305,012. It has been found that the service life of the bearing of the propeller shaft in particular is limited. Said bearing is configured as a sliding bearing having a considerable length. In EP1972545A1, page 5, a pod drive with reduction gearing is shown, in which the distance between bearings of the propeller shaft is small. As a result thereof, it has not been possible until now to make pod drives with reduction gearing commercially available which have a guaranteed service life which is comparable to conventional diesel drives.

It is an object of the present invention to prevent this drawback and to provide a reduction gearing in combination with an electric motor, by means of which prolonged operation without failure is possible in a conceivable manner.

This object is achieved with an above-described pod drive by the fact that said bearing of said propeller shaft comprises two spaced-apart bearings, the distance between the heart of both bearings in the longitudinal direction being greater than the distance between the propeller plane and the end limit of the electric motor in the longitudinal direction.

According to the present invention, the bearing positions of the propeller shaft are a considerable distance apart. Depending on the construction which is employed, which will in turn depend on the output and the expected operating conditions, such as excessively varying operating conditions with tugboats or continuous operation for relatively long periods, the distance between the various bearing positions and the design of the pod drive can be selected.

In this case, the term propeller plane is understood to mean the plane at right angles to the propeller shaft which passes through the centre of the length of the propeller blades, with the length of the propeller blades being defined as the distance from the free end of the propeller blades to the attachment at the boss.

In addition, using a smaller electric motor means that the size of the housing can be limited, which in turn reduces the drag of the pod drive and thus obviously improves handling thereof during fitting and the like.

According to a further embodiment of the present invention, the abovementioned distance between the bearings is larger than the distance between the rear side of the propeller at the location of the propeller shaft and the end part of said reduction gearing which faces the propeller. More particularly, the bearing of the propeller shaft comprises two spaced-apart bearings which are fitted on opposite sides of said reduction gearing in the direction of the rotation shaft of said electric motor.

The reduction gearing may comprise any construction which is conceivable in the prior art. By way of example, a planetary system is mentioned. Obviously, several planetary systems can be placed in series or planetary systems can be coupled to other transmissions. Other transmissions using gear wheels, chains and the like are also conceivable.

According to a preferred embodiment of the present invention, the propeller shaft extends centrally through the housing of the pod drive. In this embodiment as with other embodiments to be described below, the distance between two bearing positions preferably at least corresponds to the length of the electric motor employed. In particular, this distance is even greater, because if the reduction gearing is situated in line with the electric motor, the second bearing position is situated in line with motor/reduction gearing. According to a further embodiment of the present invention, the electric motor is situated next to the propeller shaft, that is to say that the rotation thereof preferably takes place substantially parallel to the propeller shaft. In this case, it is possible to use a number of electric motors which are arranged in a ring around the propeller shaft.

According to another advantageous variant of the present invention, the rotor of the electric motor employed is hollow and the propeller shaft extends through the latter. In this case, the propeller shaft can extend through the electric motor in its entirety, but it is also possible for it to only extend through the latter in part. In the latter case, the free end will be mounted in bearings in the interior of the rotor. In the first case, such a bearing may be provided on the outside.

With a further embodiment of the present invention, the propeller shaft is configured as a sleeve and said sleeve is provided with bearing means on the inside. Such a construction can be used particularly effectively if the sleeve is fixedly connected to the outer ring of a planetary drive. The interior of the planetary drive then preferably contains planet wheels which are provided on a fixed shaft which is connected with a further fixed part which also provides a bearing for the sleeve. Such a variant is particularly suitable for pod drives with a relatively low output, but it should be understood that these can also be scaled up. The propeller shaft, in the operating position, extends through the central wheel thereof in a contactless manner.

The pod drive may be provided with one or two propellers, these being configured as so-called pull propeller or push propeller, depending on requirements, that is to say in the first case water is moved past the housing by the propeller while in the second case the water is pushed away from the housing by the propeller. It is also possible for a sleeve-shaped jet pipe to be provided around the propeller in order to increase the thrust of the propeller at relatively low speeds. The pod drive can be configured both as a main drive and as an auxiliary drive and may, in the latter case, also be fitted in the hull of a vessel in a direction at right angles to its direction of travel. Obviously, the pod drive may be fitted so as to be rotatable with respect to the vessel.

In a further embodiment of the present invention, the pod drive is provided with two propellers of different size, for example the diameter of one propeller is 50-60% of the diameter of the other propeller. According to a further embodiment, the propeller shaft is tilted in such a way that the vertical position of the bottom side of the one small propeller corresponds to the vertical position of the bottom side of the other large propeller and near the bottom side of the ship. As a result thereof, it is already possible to produce thrust by submerging the small propeller. Due to the advantageous dynamic flow along the hull, the water will also rise at the location of the larger propeller and both propellers can even deliver thrust. In a further embodiment, the pod drive is placed underneath the stern and the tilt of the propeller shaft is positioned parallel to the occurring flow. This runs upwards at an angle along the bottom side of the stern. By also adjusting (increasing) the length of the propeller shaft to the small propeller, the vertical position of the bottom side of the small front propeller can coincide with the vertical position of the bottom side of the large rear propeller. If a tube is used around the propeller, the bottom side of the tube is in a vertical position.

The electric motor employed may comprise any type of electric motor. This means electric motors with a so-called short-circuited armature or electric motors the stator of which is configured as a permanent magnet. Preference is given to a motor in which the stator comprises windings. Preferably, a number of poles are used and more particularly at least four poles. As a result thereof, the efficiency of the electric motor can be optimized, as a result of which the use of a diesel-electric drive system results in a negligible deterioration compared to a direct drive system of a propeller by means of a fuel-operated engine.

By using such a motor with at least four poles, the magnetic field can be concentrated around the circumference, that is to say can be kept at the interface of rotor and stator, as a result of which any magnetic loss which could occur as a result of the rotor being hollow is no longer relevant.

In addition, the present invention makes it possible for the propeller to rotate at a very low speed while the electric motor rotates at a relatively high speed. As a result thereof, on the one hand, the efficiency of the propeller is increased by limiting the losses, while, on the other hand, the dimensions of the electric motor can be limited and the cost price is kept low. By way of example, a 1500 kW electric motor is mentioned which, if designed for a speed of 200 rpm would be approximately 2.5-3 times as large as an electric motor which is designed for a speed of 600 rpm and would be proportionally more expensive.

The invention will be explained below by means of exemplary embodiments, in which:

FIG. 1 diagrammatically shows a vessel provided with a pod drive according to the invention;

Figure 4:
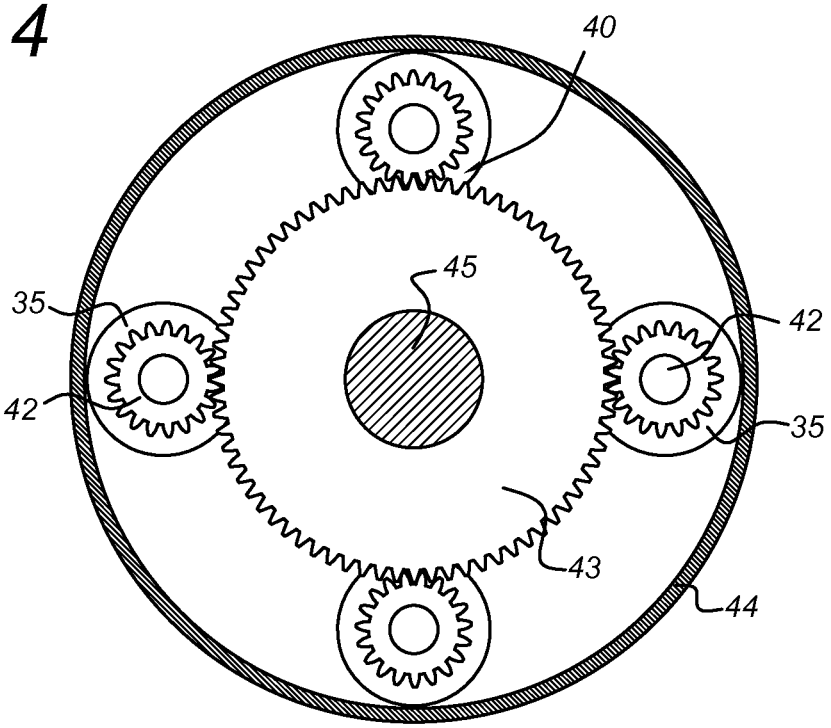
Figure 6:
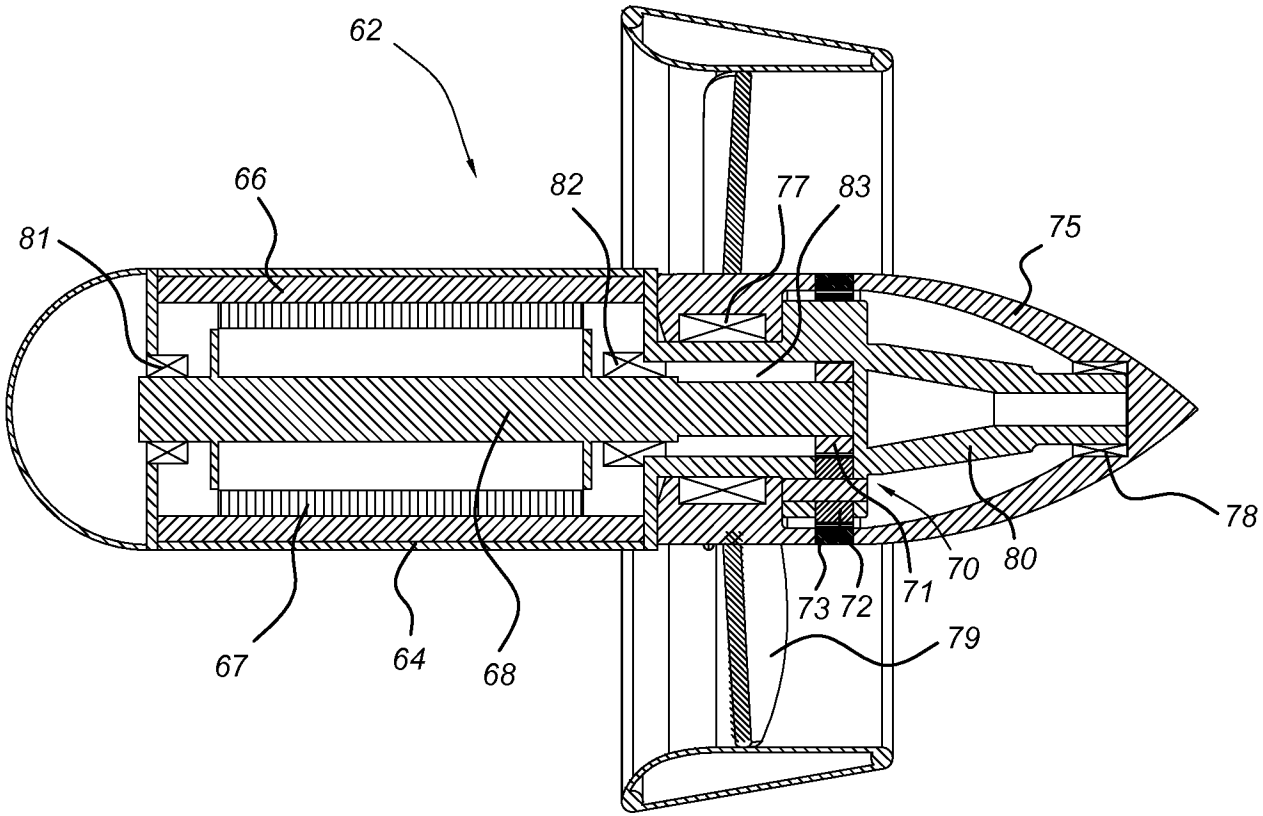

FIG. 4 diagrammatically shows a detail of an alternative embodiment of the invention;

FIG. 5 diagrammatically shows a number of variants of the above-described embodiment;

FIG. 6 shows a further embodiment of the invention in two variants; and

Figure 7:
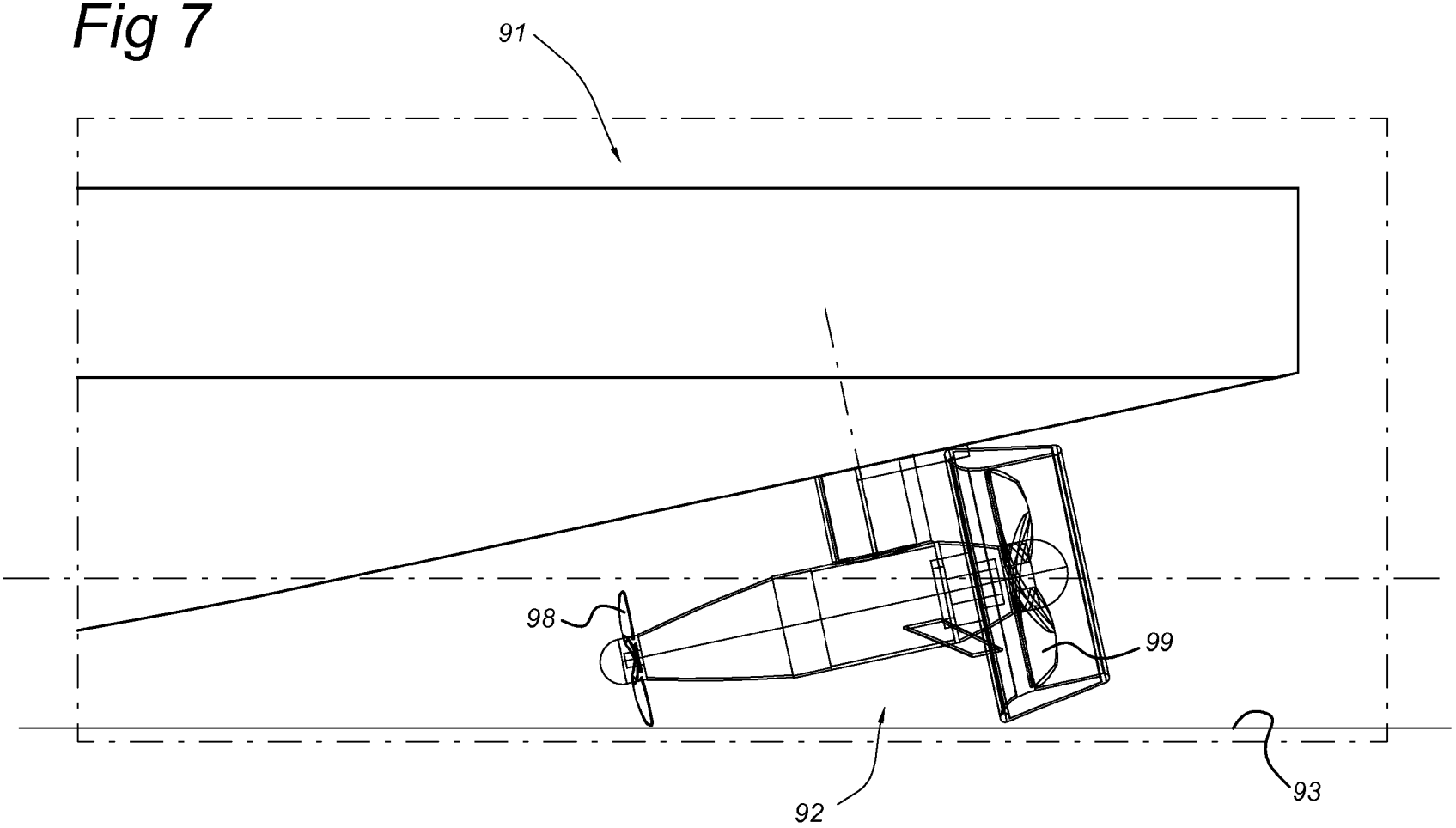

FIG. 7 shows a further embodiment with a pod drive at an angle underneath a stern with two propellers of different diameter.

Figure 1:
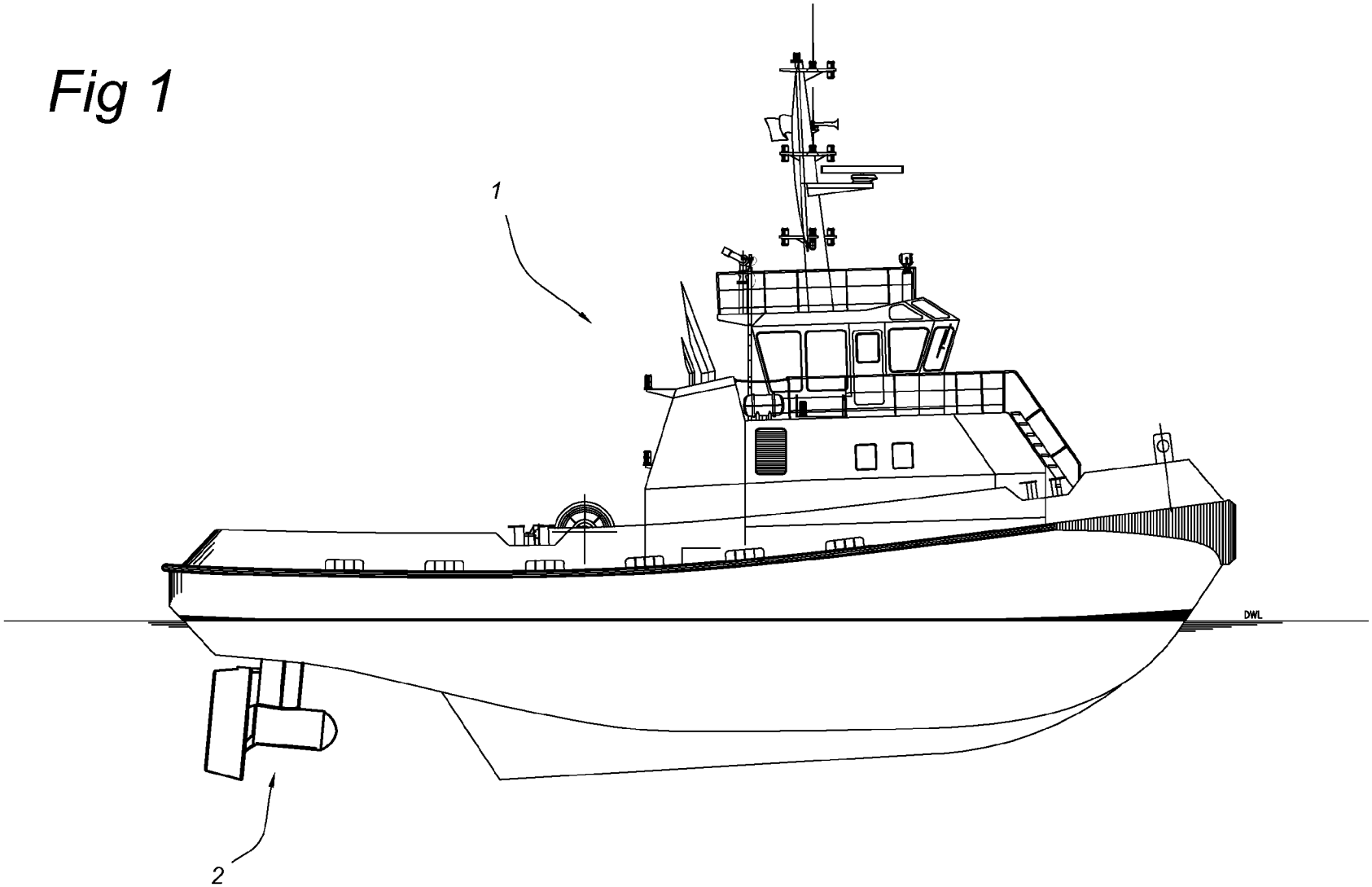

In FIG. 1, a vessel is denoted by reference numeral 1. This may be any type of vessel of any desired size, optionally sea-going. A pod drive 2 is fastened thereto with a fastening means 3 in a manner so as to be rotatable. It will be understood that more than one pod drive 2 can be used or that such a pod drive can be used for steering (bow propeller and the like). The vessel contains one or more diesel-generator sets (not shown) for generating the electric power for driving the electric motor of the pod drive to be described below.

Figure 2:
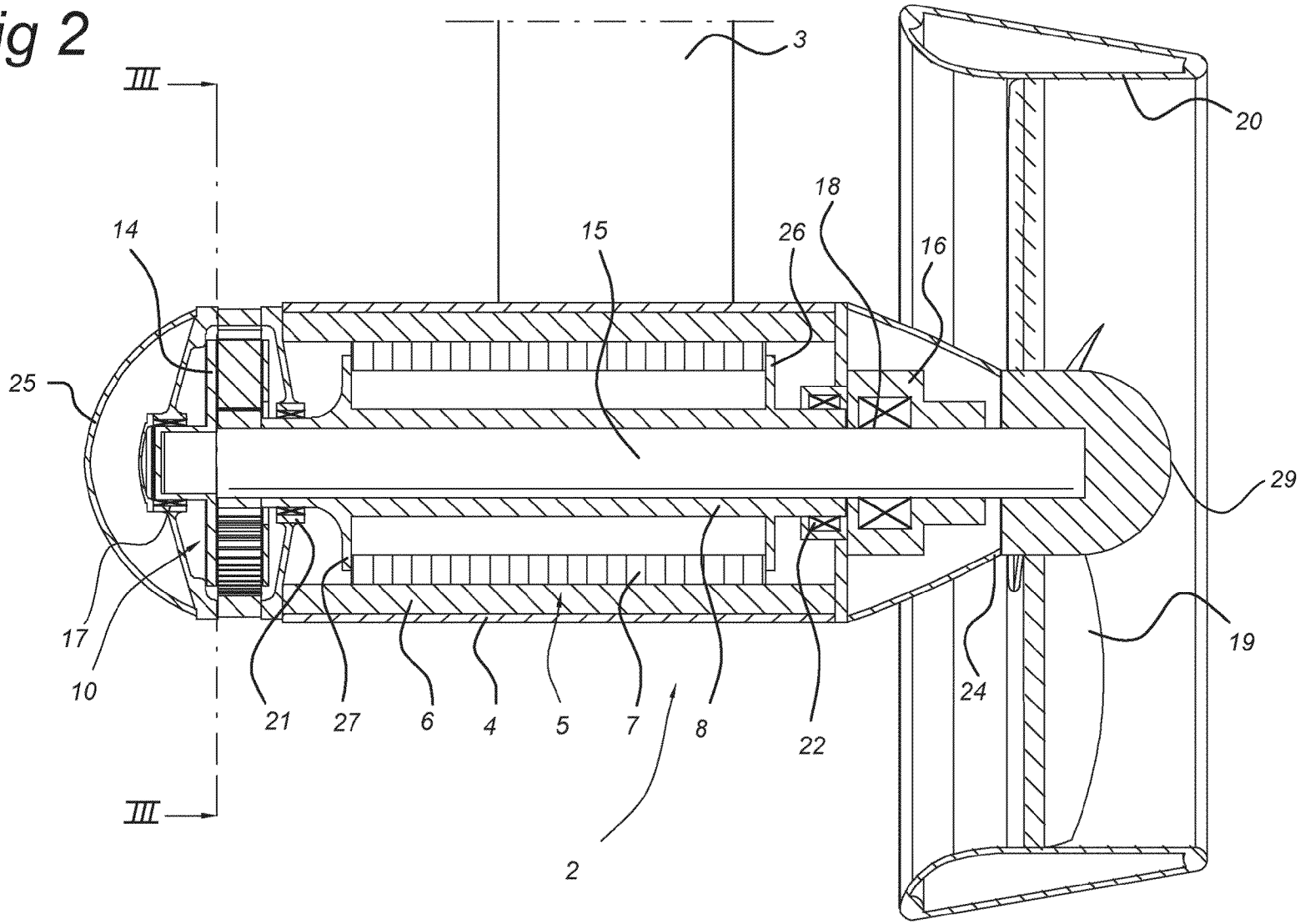
FIG. 2 shows a cross section of the pod drive of the vessel illustrated in FIG. 1.

Said pod drive is illustrated in FIG. 2 and comprises a housing 4, inside which an electric motor 5 is provided with a stator 6 consisting of a number of poles, with electrical field windings producing magnetism. The electric motor 5 may be an electric rotary engine. The rotor is shown as a short-circuited armature 7 and is provided with a hollow shaft 8 which is mounted on bearings 21 and 22 of the housing. The housing has a first end 24 and a second end 25. It will be understood that the expressions "first" and "second" have been chosen arbitrarily and can be changed around. The motor 5 also has a first end limit 26 and a second end limit 27.

Figure 3:
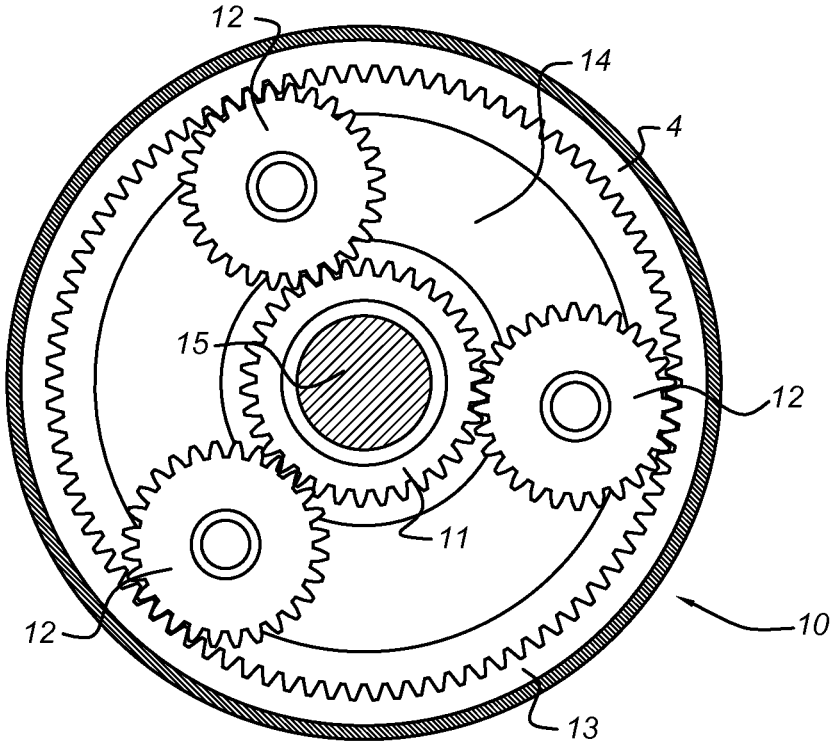
FIG. 3 shows a cross section along the line III-III from FIG. 2.

The rotor 7 is connected to a reduction gearing which in this case is configured as a planetary system, the details of which can be found in FIG. 3.

The rotor 7 is connected to an internal central hollow gear wheel (sun gear) 11 of the planetary system 10.

The propeller shaft extending through the rotor 7 and more particularly the hollow shaft 8 and the hollow gear wheel 11 is connected to the planet carrier 14 carrying the planet wheels 12 which, on the one hand, engage with the ring 13 which is fixedly connected to the housing and has internal toothing and, on the other hand, with the central hollow gear wheel 11. The length of the propeller blades is defined as the distance from the free end of the propeller blades to the attachment at the boss 29, the boss being the central hub of the propeller. For the sake of clarity, the internal mounting of the planetary box parts is not shown separately.

The output shaft of the planetary system, that is to say the propeller shaft 15, is mounted in bearings at both 17 and 18. That is to say there is a considerable distance between the bearing positions 17 and 18, the position of each of the bearings 17, 18 being indicated by the vertical, dashed lines 37 and 38. which at least corresponds to the length of the electric motor and in this case is even larger because the second bearing position 17 is situated in line with the electric motor/reduction gearing. Reference numeral 16 denotes a thrust bearing which absorbs the axial pressure forces acting on propeller 19. It is also possible to combine this thrust bearing with the first bearing position 18. A sleeve or jet pipe 20 is provided around the propeller. In addition to the axial forces mentioned earlier, the propeller also produces radial forces which result in flexural stresses in the propeller shaft. These gradually decline from bearing 16 in the direction of bearing 17. As a result thereof, it is possible for the propeller shaft to have a diameter which gradually decreases, with the minimum diameter being limited by the drive torque to be transmitted. Both the sun gear and the electric motor have a small tolerance with respect to the radially vibrating propeller shaft and are supported on bearings towards the housing. As a result thereof, the sun gear is prevented from transmitting uneven loads to the individual planet wheels resulting in increased wear of the reduction gearing. By way of example, a value of at least 2 mm on the diameter is mentioned.

According to an advantageous embodiment of the above-described embodiment, the diameter of the propeller shaft at the location of the sun gear is at least 15% of the external diameter of the stator of the electric motor. According to a particular embodiment, the diameter of the propeller shaft increases in the direction towards the connection with the propeller and is, for example, 25% larger at the connection of the propeller than at the above-described location of the reduction gearing.

In addition, further measures can be taken to increase the service life of the planetary transmission in particular. Thus, provision can be made to ensure that there is no bending load between the input shaft and the output shaft in order to prevent wear. To this end, couplings and the like can be used which accept a slight oblique position, such as for example a splined connection.

In addition, uniform loading between sun gear and the various planet wheels can be achieved by providing a slight degree of play in the radial direction of the sun gear at the location of the toothing. This can be achieved, for example, by fitting the sun gear on a shaft which is provided at the other end with a splined connection and is inserted into the motor shaft, with such a shaft not requiring any additional support.

It should be understood that the above-described embodiments of the construction of the propeller shaft and the sun gear, respectively, can also be used with the variants to be described below.

FIG. 4 shows a variant of the present invention. Only relevant differences are shown in this figure. The propeller shaft is denoted by reference numeral 45 and extends substantially along the entire length of the housing 44 of the pod drive. Both in this example and in the previous example, the propeller shaft is situated centrally in the housing. It will be understood that it is possible to deviate therefrom without departing from the scope of the present invention. In contrast to the earlier variant, in which the propeller shaft 15 passes through the hollow rotor 7, the present embodiment comprises a number of electric motors 35 which are arranged around the propeller shaft 45 in the form of a ring, with the outer boundaries of the various electric motors 35 leaving sufficient space for the propeller shaft 45. Each of the electric motors 35 is provided with a small gear wheel 42, while the propeller shaft 43 is provided with a large gear wheel 43. It will be understood that the reduction gearing 40 which is produced in this way can also be configured in a different manner, for example using the above-described planetary system, or may be provided with a further reduction, for example using a planetary system.

Figure 5A:
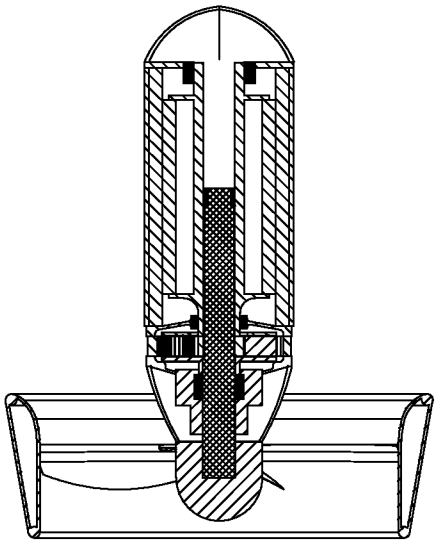
Figure 5B:
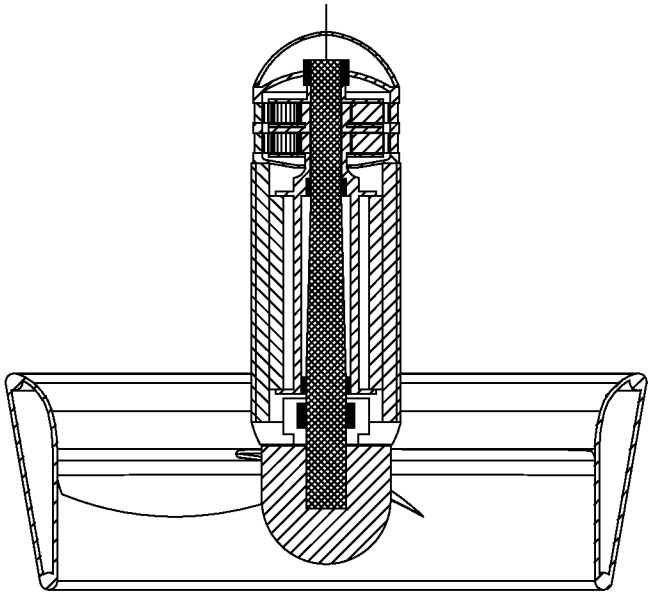

FIG. 5*a-d* shows a number of variants of the construction according to the invention shown in FIG. 2. In all variants except that of FIG. 5*b*, the reduction gearing is situated between the electric motor and the propeller. In the variant from FIG. 5*a*, the propeller shaft does not extend as far as the second end of the housing, but is mounted in the hollow rotor. In FIG. 5*b*, the reduction gearing is fitted in the manner shown in FIG. 2, but consists of a stepped construction, as a result of which a larger transmission ratio can be selected. As a result thereof, the electric motor can rotate at a higher speed and can be made smaller. In FIG. 5*b*, a double reduction gearbox is used. The electric motor is mounted on the propeller shaft, see internal bearings between motor and propeller shaft.

Figure 5C:
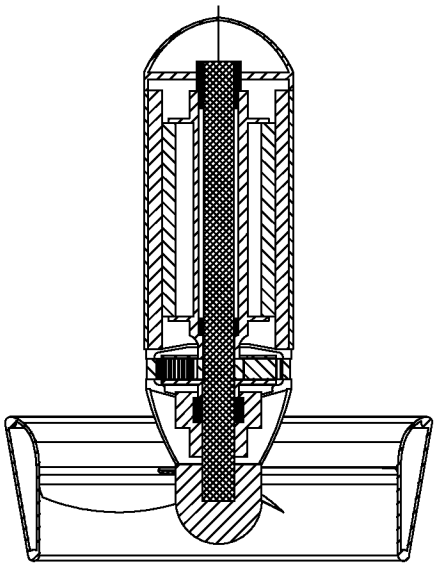

In FIG. 5*c*, the propeller shaft at the reduction gearing is mounted in the hollow rotor and the hollow rotor is then mounted on the propeller shaft at the second end, which propeller shaft is in turn mounted in the housing. It will be understood that this way of mounting at the second end can also be used with the earlier variants, whereas with the construction according to FIG. 5*d*, a bearing can be used at the second end such as shown, for example, in FIG. 5*c*.

Figure 5D:
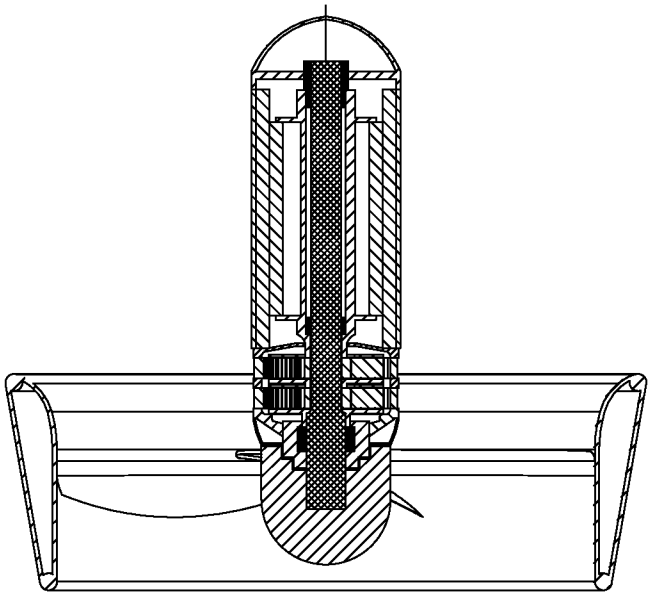

FIG. 5*d* shows a variant in which a double reduction gearing is used.

FIG. 6 shows a variant of the construction illustrated here. In this case, all reference numerals have been increased by 60 in order to denote the respective parts. The pod drive is denoted overall by reference numeral 62 and provided with an electric motor consisting of a stator 66 and a rotor 67. In this variant embodiment, rotor 67 is not hollow and is mounted using bearings 81 and 82 on either side in the conventional manner in housing 64. The output shaft 68 thereof is fixedly connected to the sun gear 71 of a planetary system 70. The planet wheels 72 thereof are fixedly fitted and the ring gear wheel 73 is fixedly connected to a sleeve 75 which acts as a hollow propeller shaft and is fixedly connected to propeller 79. The fixed bearing pins (not shown earlier) of the planet wheels 72 are connected to a bearing support 80 to which a bearing 78 is attached, the other side of which rests on the inside of the sleeve 75. The other side of the sleeve 75 is mounted at reference numeral 77 on the bearing support 80 which is fixedly connected to housing 64. With this embodiment, the distance between the electric motor end limit and the propeller is minimal and considerably smaller than the distance between both axes of the bearings of the propeller shaft/propeller sleeve. Furthermore, it is possible to fit an additional reduction gear between the electric motor shaft and the planetary gearbox, as a result of which the total reduction is increased. Due to the relatively low torque, this reduction gear can be made smaller and be arranged inside the bearing support 80, or between the planetary gearbox and the electric motor (for example at the position denoted by 83), or on the other side of the planetary gearbox using a through-axle.

As has been indicated above, it is not necessary with this construction to drill through the rotor, as a result of which a standard electric motor suffices as the drive, thus resulting in further cost savings, while, on the other hand, due to the significant distance between the bearings 77 and 78, a sufficiently long service life can be achieved.

According to a variant, the position of the propeller 79 is moved towards the bearing 78 and situated between the reduction gearing 70 and the bearing 78.

FIG. 7 shows a further embodiment of the construction according to the present invention, in which in particular the positioning underneath the rear side of a vessel is relevant. This vessel is denoted by reference numeral 91 and the pod drive by reference numeral 92. The pod drive is provided with two propellers 98 and 99, with propeller 98 being a relatively small propeller and propeller 99 having an effective blade diameter which is, for example, 1.5-3 times as large. Reference numeral 93 denotes a horizontal line. It can be seen that the bottom side of the small propeller 98 and the bottom side of the large propeller 99 (with the associated sleeve) are situated at approximately the same level 93, due to the tapering on the rear side of the vessel. In this way, it is possible to provide optimum thrust, even with relatively small water depths. As a result of using the small propeller 98, it is possible to achieve such an advantageous dynamic flow in combination with the shape of the hull, that the large propeller can also supply considerable steering force.

Upon reading the above, those skilled in the art will immediately realize that many variants of the invention are possible. Such variants are obvious after reading the above and are covered by the scope of the attached claims. In addition, rights are expressly sought for embodiments as described in claims 2 et seq. in which the subject matter of claim 1 has not been (fully) realised.

The invention claimed is:

1. A pod drive (2) comprising:

a housing (4) fastened to a vessel (1), wherein said housing has a longitudinal direction and is provided with opposite first (24) and second (25) ends; and an electric motor (5) fitted in said housing, wherein a rotation shaft of said electric motor extends between the first and second ends of said housing, and an input shaft of a reduction gearing (10) is connected to said electric motor (5), wherein an output propeller shaft (15) of said reduction gearing comprises a mounted propeller shaft which extends through the housing to a propeller (19) which is situated outside the housing, wherein said propeller shaft (15, 45) extends through said housing at the first end (24) of said housing, wherein a bearing of said propeller shaft comprises two spaced-apart first and second bearings (17, 77; 18, 78), a distance between positions of the first bearing (18, 78) and the second bearing (17, 77) in the longitudinal direction being greater than a distance between a propeller plane and a first end limit of the electric motor in the longitudinal direction, wherein said reduction gearing comprises a planetary drive, wherein said reduction gearing (10, 40) is fitted between a second end limit of said electric motor and the second end (25) of said housing, and wherein a rotor (7) of said electric motor is hollow and said propeller shaft (15) extends through the electric motor and, in an operating position, extends through a central wheel of the planetary drive without touching the central wheel.

2. The pod drive according to claim 1, wherein the second bearing (17) is situated between said first end limit (26) and said second end (25) of the electric motor.

3. The pod drive according to claim 1, wherein said first bearing (18) of said propeller shaft (15, 45) is situated between said second end limit (27) of said electric motor (5) and the first end (24) of said housing.

4. The pod drive according to claim 1, wherein said first bearing position (18) is situated between said first end limit (26) of said electric motor and the first end (24) of the housing.

5. The pod drive according to claim 1, wherein couplings are fitted between the propeller shaft (15) and a planet carrier (14) of the planetary drive, wherein the couplings transfer no bending loads.

6. The pod drive according to claim 5, wherein the couplings comprise a splined connection.

7. The pod drive according to claim 1, wherein the reduction gearing is situated directly next to the bearing (17).

8. The pod drive according to claim 1 o, wherein said electric motor comprises a stator (6) with four poles.

9. A vessel comprising a pod drive according to claim 1, configured as the main drive.

10. A vessel comprising a pod drive according to claim 1, configured as steering drive.

11. A vessel according to claim 9, wherein the housing of the pod drive is fitted to the vessel, in such a way that the housing so as to be rotatable with respect to said vessel.

12. A pod drive (2) comprising:

a housing (4) that fastens to a vessel (1), wherein said housing has a longitudinal direction and extends in the longitudinal direction to define a first end (24) and an opposite, second (25) end;

a propeller (19) situated outside the housing, the propeller (19) comprising a bearing;

an electric motor (5) fitted in said housing, a rotor (7) of said electric motor being hollow, the electric motor including a rotation shaft that extends between the first and second ends (24, 25) of said housing, wherein said electric motor (5) comprises a first end limit (26) and an opposite, second end limit (27);

a reduction gearing (10) with i) an input shaft connected to said electric motor (5), ii) an output propeller shaft (15) that comprises a mounted propeller shaft which extends through the housing to the propeller (19), wherein said propeller shaft (15, 45) extends through said housing at the first end (24) of said housing, and iii) a planetary drive having a central wheel and a planet carrier (14), wherein the bearing of said propeller shaft comprises two spaced-apart first and second bearings (17, 77; 18, 78), a distance between positions of the first bearing (18, 78) and the second bearing (17, 77) in the longitudinal direction being greater than a distance between a propeller plane and the first end limit of the electric motor in the longitudinal direction, the term propeller plane being a plane at right angles to the propeller shaft and passing through a center of a length of the propeller blades, with the length of the propeller blades being defined as a distance from a free end of the propeller blades to an attachment at a boss of the propeller, wherein said reduction gearing (10, 40) is fitted between the second end limit of said electric motor and the second end (25) of said housing, and wherein said propeller shaft (15) extends through the electric motor and, in an operating position, extends through the central wheel of the planetary drive without touching the central wheel.

13. The pod drive according to claim 12, wherein, the second bearing (17) is situated between said first end limit (26) and said second end (25) of said housing.

14. The pod drive according to claim 12, wherein said first bearing (18) of said propeller shaft (15, 45) is situated between said second end limit (27) of said electric motor (5) and the first end (24) of said housing.

15. The pod drive according to claim 12, wherein said first bearing position (18) is situated between said first end limit (26) of said electric motor and the first end (24) of the housing.

16. The pod drive according to claim 12, further comprising couplings fitted between the propeller shaft (15) and the planet carrier (14) of the planetary drive, and wherein the couplings transfer no bending loads, and the couplings comprise a splined connection.

17. The pod drive according to claim 12, wherein the reduction gearing is situated directly next to the bearing (17), and said electric motor comprises a stator (6) with four poles.

18. The pod drive according to claim 12, wherein the pod is connected to a vessel and is configured as a main drive or as a steering drive.

19. The pod drive according to claim 12, wherein the housing of the pod drive is fitted to a vessel, with the housing being rotatable with respect to the vessel.

* * * * *